US012385371B1

(12) United States Patent
Jefferies

(10) Patent No.: US 12,385,371 B1
(45) Date of Patent: Aug. 12, 2025

(54) PLUNGER LIFT SYSTEM

(71) Applicant: James Allen Jefferies, Granbury, TX (US)

(72) Inventor: James Allen Jefferies, Granbury, TX (US)

( * ) Notice: Subject to any disclaimer, the term of this patent is extended or adjusted under 35 U.S.C. 154(b) by 0 days.

(21) Appl. No.: 18/485,691

(22) Filed: Oct. 12, 2023

(51) Int. Cl.
*E21B 43/12* (2006.01)

(52) U.S. Cl.
CPC ..... *E21B 43/121* (2013.01); *E21B 43/123* (2013.01)

(58) Field of Classification Search
CPC ..... E21B 43/121; E21B 34/14; E21B 34/142
See application file for complete search history.

(56) References Cited

U.S. PATENT DOCUMENTS 7,513,301 B2 * 4/2009 Victor ..... E21B 43/121 166/105
8,347,954 B2 * 1/2013 Amies ..... E21B 43/121 417/58
11,578,570 B2 * 2/2023 Boyd ..... E21B 43/13
2016/0076568 A1 * 3/2016 Dilmaghanian ..... F16B 21/18 29/525.01
2017/0058652 A1 * 3/2017 Boyd ..... F04B 53/12
2017/0107802 A1 * 4/2017 Kuykendall ..... E21B 43/121
2017/0261108 A1 * 9/2017 Soler ..... F16J 15/3212
2020/0056450 A1 * 2/2020 Duthie ..... E21B 34/14
2022/0275712 A1 * 9/2022 Boyd ..... E21B 43/121

* cited by examiner

*Primary Examiner* — Kipp C Wallace
(74) *Attorney, Agent, or Firm* — James E. Walton

(57) ABSTRACT

A plunger lift system for lifting fluids in a well bore includes a plunger body having a central bore, and a bypass valve assembly disposed at a lower end of the plunger body. The bypass valve assembly includes a valve cage, a valve stem disposed at least partially within the valve cage, a clutch bobbin carried by the valve cage and being operable associated with the valve stem, and at least one canted coil spring carried by the clutch bobbin for controlling movement of the valve stem.

13 Claims, 9 Drawing Sheets

SECTION A-A

SECTION A-A

PLUNGER LIFT SYSTEM

BACKGROUND

1. Field of the Invention

The present application generally relates to oil and gas production operations, and more particularly, to gas-lift plunger devices for restoring production to wells by lifting production fluids to the surface.

2. Description of Related Art

Presently, gas lift plunger devices have been in use for many decades and have a long history of development. The goal of these devices is to restore production in wells by using the gas pressure in the well to lift the production fluids to the surface. The plunger must be able to reach the bottom of the well and successfully build up pressure to start production of a well. As the plunger descends into the well, the fluid must be able to flow through the plunger. Once the plunger reaches the desired location, the push rod inside of the plunger is triggered to close a valve, thereby allowing the gas pressure to build up and lift the fluids to the surface. Multiple variations have been made over the years to increase productivity of these systems. One focus has been on controlling the volume of the fluid flowing through the plunger while the plunger descends. Another focus has been on setting the push rod and sealing the system.

While multiple improvements have been made throughout the years to improve these systems, not all of them are cost effective or are long lasting, and many shortcomings remain.

DESCRIPTION OF THE DRAWINGS

The novel features believed characteristic of the application are set forth in the appended claims. However, the application itself, as well as a preferred mode of use, and further objectives and advantages thereof, will best be understood by reference to the following detailed description when read in conjunction with the accompanying drawings, wherein:

Figure 1:
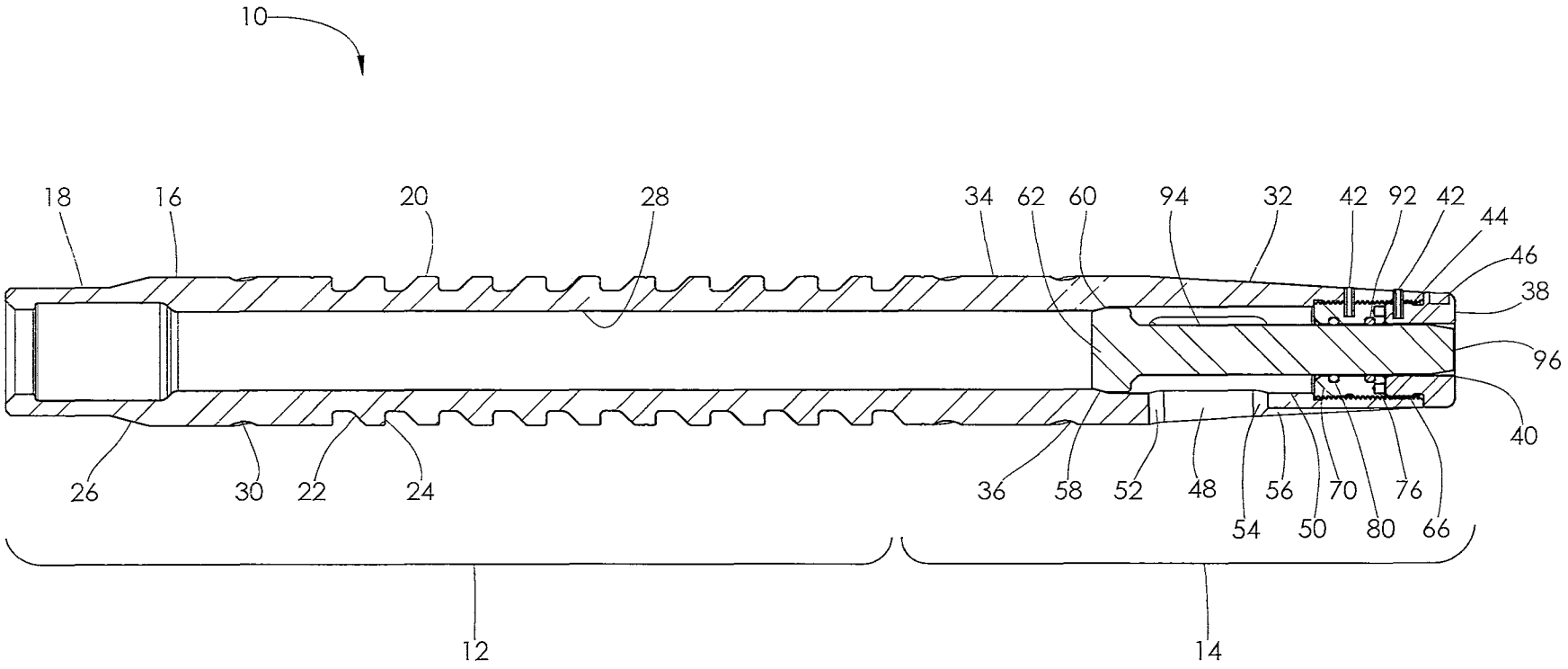
FIG. 1 is a longitudinal cross-sectional view of a plunger lift system according to a preferred embodiment of the present application.

While the method and device of the present application are susceptible to various modifications and alternative forms, specific embodiments thereof have been shown by way of example in the drawings and are herein described in detail. It should be understood, however, that the description herein of specific embodiments is not intended to limit the invention to the particular embodiment disclosed, but on the contrary, the intention is to cover all modifications, equivalents, and alternatives falling within the spirit and scope of the present application as defined by the appended claims.

DETAILED DESCRIPTION OF THE PREFERRED EMBODIMENT

Illustrative embodiments of a plunger lift system according to the present application are provided below. It will of course be appreciated that in the development of any actual embodiment, numerous implementation-specific decisions will be made to achieve the developer's specific goals, such as compliance with assembly-related and business-related constraints, which will vary from one implementation to another. Moreover, it will be appreciated that such a development effort might be complex and time-consuming but would nevertheless be a routine undertaking for those of ordinary skill in the art having the benefit of this disclosure.

Figure 2B:
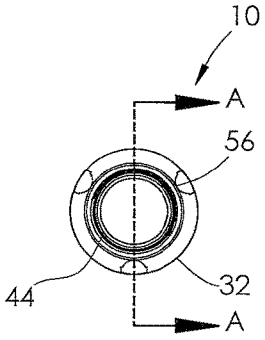
FIG. 2B is an end view of the plunger lift system of FIG. 2A.
Figure 2A:
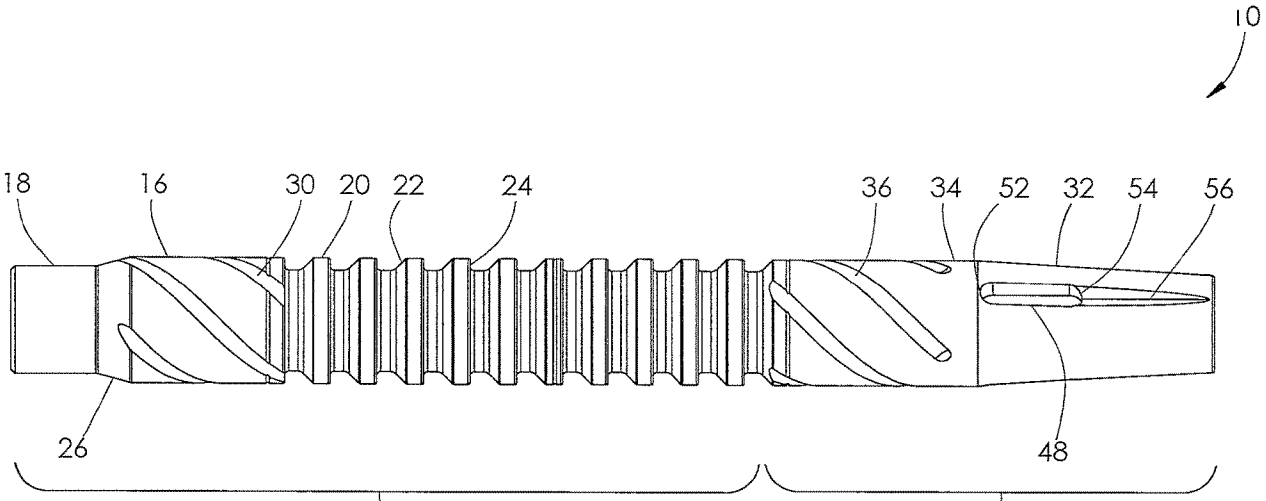
FIG. 2A is a side view of the plunger lift system of FIG. 1, shown with the valve stem assembly removed.

Referring to FIG. 1 and FIGS. 2A through 2C in the drawings, a plunger lift system 10 according to the preferred embodiment of the present application is illustrated. Plunger 10 is preferably a continuous piece of material with two subsections, a plunger section 12, and a rotary bypass valve assembly 14. Plunger section 12 includes a plunger body 16, an upper end 18, outer rings 20, a sloped surface 22, a ring underside 24, a tapered portion 26, a central bore 28, and one or more helical grooves 30. Outer rings 20 are preferably a series of concentric rings around plunger section 12 that provide a seal against a well casing and reduce friction as plunger 10 descends or ascends inside a well bore. Sloped surface 22 on upper side of each ring facilitates ascent by reducing friction due to turbulence of the fluid inside of the well. Underside 24 of the outer rings 20 may be configured to serve a purpose, such as minimizing drag, improving sealing, providing a flushing action upon descent, etc. These alternative uses of underside 24 may be designed to meet a particular need of the well in which plunger 10 will be used. In alternative embodiments, outer rings 20 may be formed as a continuous helix instead of concentric rings, for example. As seen in FIG. 2A, helical grooves 30 extend helically around plunger body 16. Grooves 30 reduce drag and friction caused by turbulent fluids on plunger 10 inside of the well bore by causing plunger 10 to rotate while descending.

Rotary bypass valve assembly 14 includes a valve cage 32, a valve cage body 34, valve cage helical grooves 36, an end cap 38, a bore 40, one or more roll pins 42, threads 44, one or more sockets 46, one or more bypass ports 48, a cylindrical bore 50, a seat 58, a chamfered perimeter of stem head 60, an enlarged valve stem head 62, a clutch assembly 64, a valve stem 94, and a valve stem lower end 96. Each port 48 preferably includes a lower rounded end 52, an upper rounded end 54, and a ramp 56. Body 34 of valve cage 32 is preferably continuously connected with the lower end of plunger body 16, such that plunger 10 preferably forms one continuous piece of material. Body 34 of valve cage 32 includes helical grooves 36, similar to helical grooves 30 on plunger body 16, to assist with reducing friction and drag on plunger 10, while plunger 10 is in the well bore. End cap 38 may be threaded into the lower end of the valve cage 32 at threads 44. Once end cap 38 has been threaded into place, end cap 38 can be secured with set screws or roll pins 42. One or more sockets 46 for removing or tightening end cap 38 with a spanner wrench or other appropriate tool (not shown) are disposed in the outer surface of end cap 38. It is preferred that end cap 38 be tightened to a selected torque to prevent end cap 38 from coming undone while plunger 10 is in use. Valve cage 32 includes multiple bypass ports 48 disposed at equal radial intervals around valve cage 32. The radius of valve cage 32 is the same as body 34 on one end while smaller on the end where end cap 38 is attached. This angled slope in valve cage 32 reduces drag and turbulence on plunger 10 when it is inserted to a well.

Figure 2C:
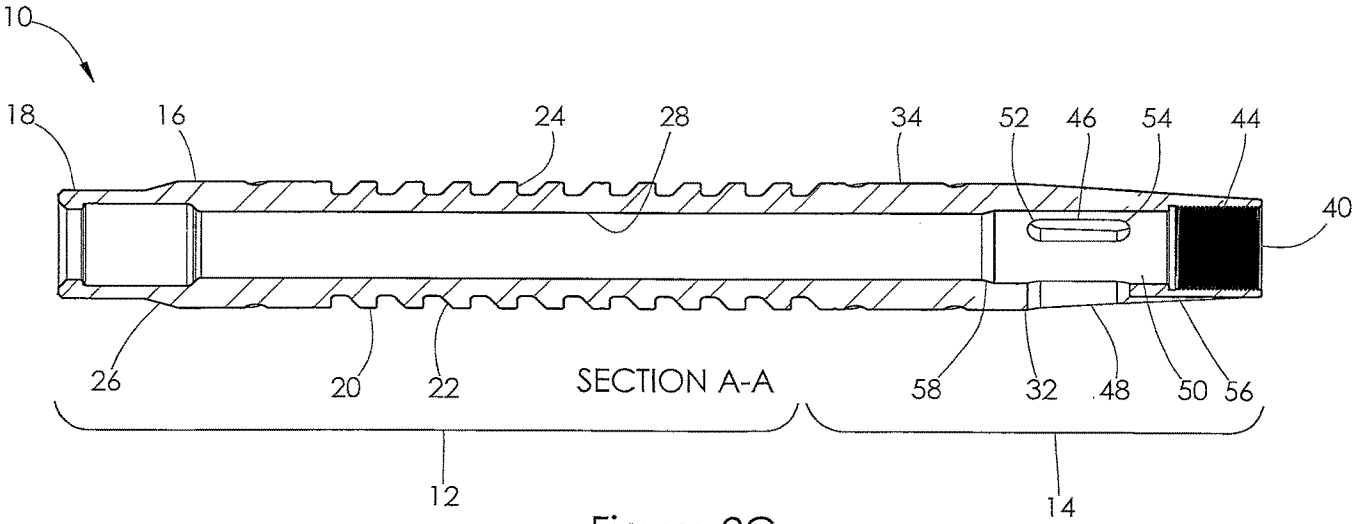
FIG. 2C is a longitudinal cross-sectional view of the plunger lift system of FIG. 2A taken at A-A of FIG. 2B.

FIGS. 1 and 2C illustrate cross-sectional views of plunger 10. These views show sealing rings 20 disposed along the axis of plunger 10. Shortened tapered portion 26 at upper end 18 of plunger body 16 permits plunger 10 to retain the full diameter of plunger body 16 over a maximum portion, preferably at least 70%, of the length of plunger body 16. By maintaining this diameter, tapered portion 26 improves the sealing performance as plunger 10 rises within the well bore and lifts the fluids inside of the well bore. Plunger body 16 is preferably hollow with cylindrical bore 28 to permit the flow of fluid inside of plunger 10, while plunger 10 descends into the well bore. During descent, fluid flow enters the lower end of plunger 10 through bypass ports 48 and cylindrical bore 50 in valve cage 32, and flows through cylindrical bore 28 of plunger body 16.

As shown in the cross-sectional view of FIG. 1, bypass valve assembly 14 includes valve stem 94 disposed within bore 40 of end cap 38, clutch assembly 64 encircling and operably associated with valve stem 94, and elongated bypass port 48. Although three such equally spaced ports 48 are preferred, the number of ports 48 may be varied in alternative embodiments. Bypass ports 48 facilitate the flow of fluids during descent of plunger 10 by allowing fluid to flow into plunger 10 through bypass ports 48 up into bore 28. Bypass ports 48 relieved in valve cage 32 reduces the turbulence of the fluid and increases the stability of plunger 10 while inside the well bore. Valve stem 94 includes enlarged valve stem head 62 with chamfered perimeter 60, which is configured to mate with seat 58 formed in the lower end of bore 28. This configuration provides a poppet-type valve to regulate the flow of fluid through plunger 10. Once plunger 10 reaches the bottom of the well bore (or a selected location within the well bore), the inertia of plunger 10 hitting the well bottom will overcome the spring force of clutch assembly 64, enabling valve stem 94 to move upward through bore 50 in bypass valve cage 32 and against seat 58 in plunger body 16 to seal bypass valve assembly 14. This poppet valve configuration seals bypass valve assembly 14, thereby stopping the flow of fluid through plunger 10. Thus sealed, bypass plunger 10 functions like a piston, allowing the gas pressure in the well to lift bypass plunger 10 upward, carrying accumulated fluids above plunger 10 to the wells surface.

Valve stem 94 is preferred made of type 174 heat treated stainless steel. Clutch assembly 64 is preferably made of type 174 steel, 4140 steel, 416 steal, or similar material. The remaining components, including plunger body 16, valve cage 32, and end cap 38 are preferably made of 4140 heat treated alloy steel. While particular types of steel are stated in this application, it will be appreciated that the various components of plunger 10 may be fabricated from any similar type of heat treated steel or similar material. These materials are readily available as solid "rounds" in a variety of diameters, as is well known in the art.

Continuing with reference to FIGS. 2A through 2C in the drawings, bypass valve cage 32 includes at least one bypass port 48. Each bypass port 48 is an elongated slot cut through the wall of body 34 of valve cage 32 and includes lower rounded end 52 and upper rounded end 54. Ports 48 are located at equal distances from each other around valve cage 32. In addition, both lower end 52 and upper end 54 of each port 48 may be cut at selected angles into cage 32 to reach bore 50. This relief of lower ends 52 and upper ends 54 of ports 48 facilitates the flow of fluid through ports 48 as bypass plunger 10 descends down the well bore. A ramp 56 may be disposed adjacent each rounded end 54 of each port 48 to further smooth the path for fluid flow at lower end 54 of each port 48. It is preferred that each ramp 56 be substantially parallel with the longitudinal axis of valve cage 32. The surface of each ramp 56 may be flat or curved. In alternate embodiments, lower end 52 and upper end 54 may be cut at similar angles or differing angles to better facilitate the descent of plunger 10 into the well bore, so as to decrease the turbulence and friction forces acting upon plunger 10.

Figure 3:
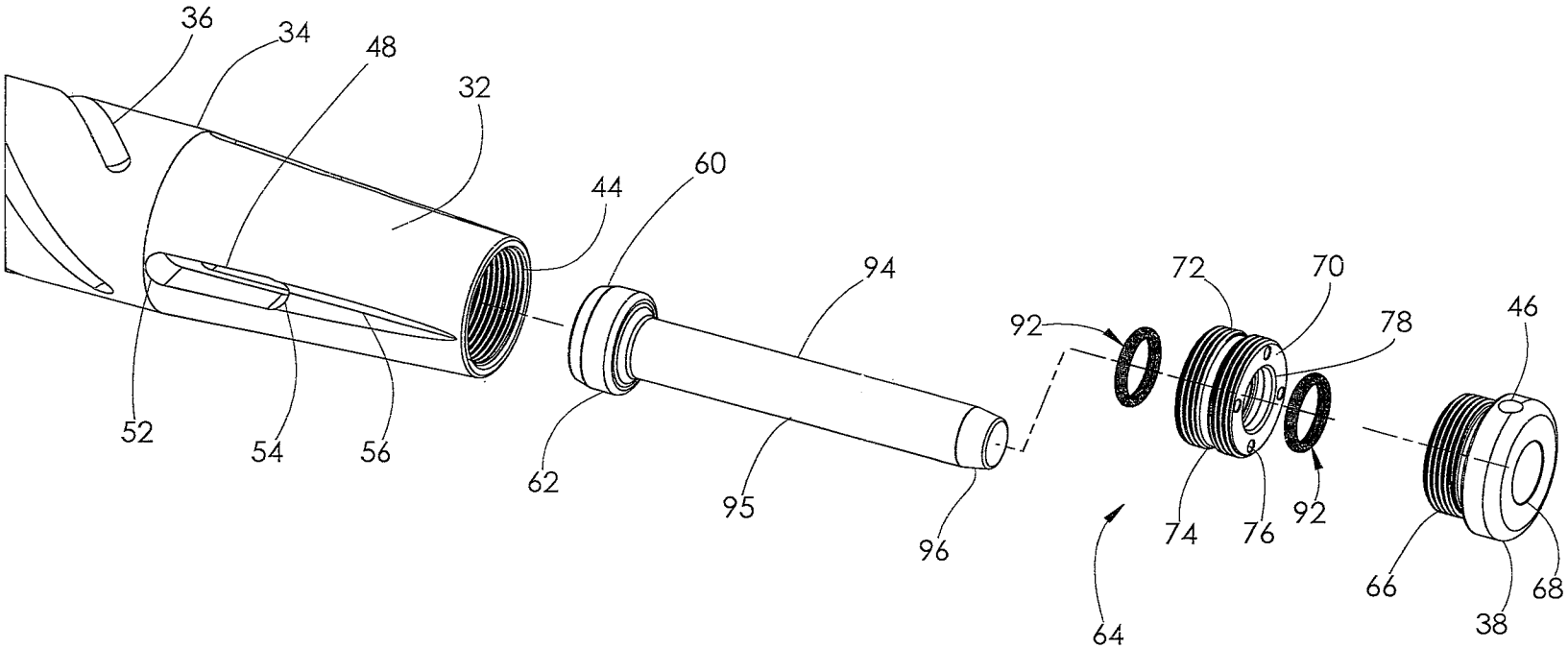
FIG. 3 is an exploded view of a valve stem assembly of the plunger lift system of FIG. 1.

Referring now also to FIG. 3 in the drawings, valve cage 32, valve stem 94, clutch assembly 64, and end cap 38 are shown in an exploded view. Valve stem 94 is operably associated with clutch assembly 64. Clutch assembly 64 is releasably connected into valve cage 32 by threading threads 72 onto threads 44 of valve cage 32. Clutch assembly 64 maintains valve stem 94 in an extended, open-valve position during the descent of bypass plunger 10; and maintains valve stem 94 in a retracted, closed-valve position during the ascent of bypass plunger 10. Clutch assembly 64 includes a clutch bobbin 70 and least one canted coil spring 92. Each canted coil spring 92 is held inside an interior annular race 93. Clutch assembly 64 is threaded into valve cage 32 and is held in place by end cap 38.

Figure 4B:
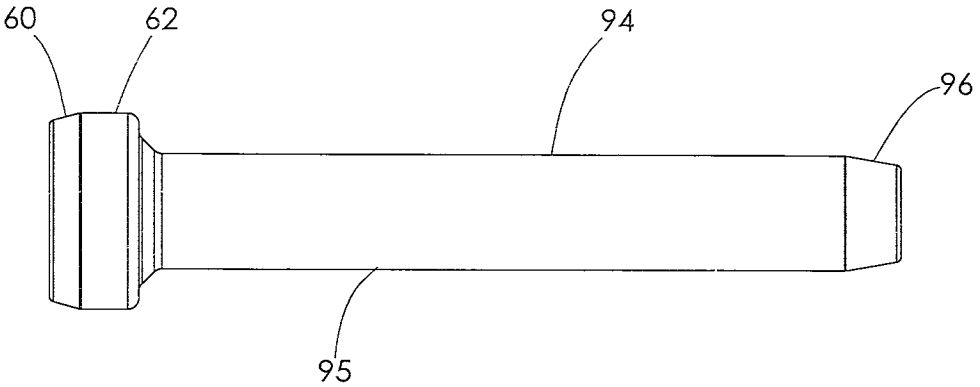
FIG. 4B is a side view of the valve stem of FIG. 4A.
Figure 4A:
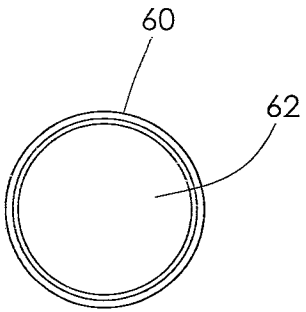
FIG. 4A is an end view of a valve stem of the valve stem assembly of FIG. 3.

Referring now also to FIGS. 4A and 4B in the drawings, valve stem 94 is illustrated. Valve stem 94 includes chamfered perimeter 60, stem head 62, and lower end 96. Valve stem 94 preferably forms a straight smooth cylindrical shaft 95. Other plunger systems use valve stems that have high friction, protrusions, upsets, and/or surface treatments along the length of the shaft to keep the valve stem from going up the plunger before hitting the bottom of the well bore. However, valve stem 94 of the present application does not need those features, as clutch assembly 64 successfully maintains the position of valve stem 94, until plunger 10 comes into contact with the bottom of the well bore. Because shaft 95 is smooth and straight, the friction force applied by the fluid in the well bore is decreased, which allows plunger 10 to descend at a faster rate with less turbulence. In addition, straight smooth shaft 95 allows valve stem 94 to be more easily manufactured, and allows clutch assembly 64 to function more efficiently.

Figure 5A:
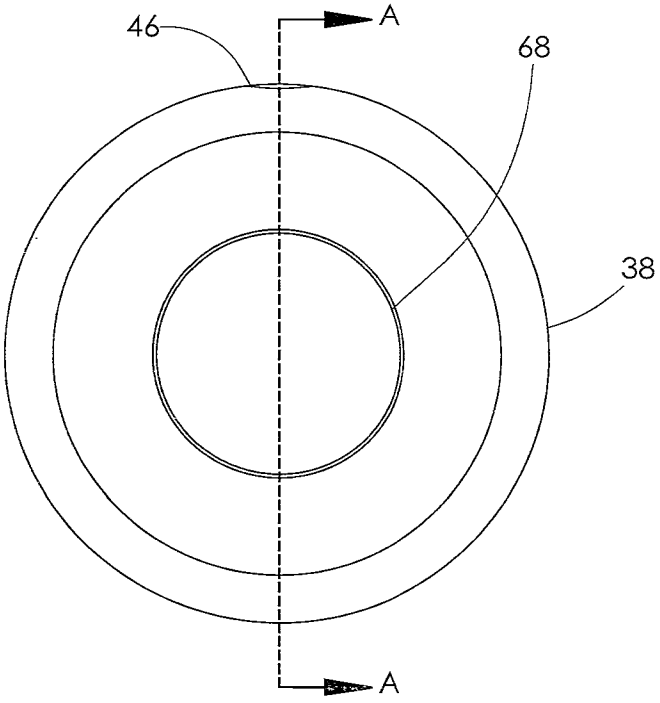
FIG. 5A is an end view of an end cap of the valve stem assembly of FIG. 3.
Figure 5B:
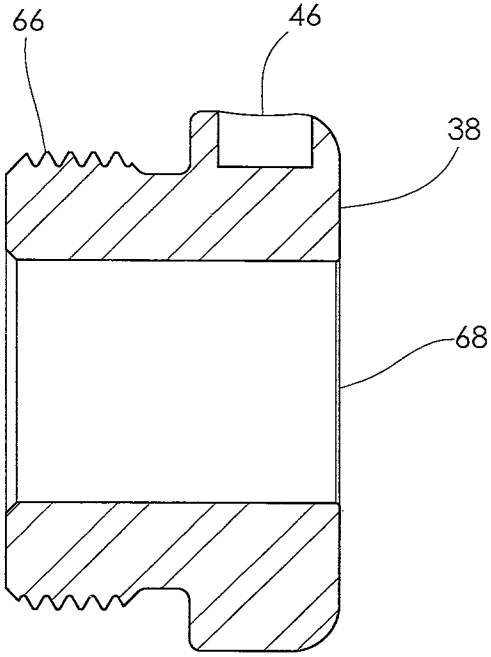
FIG. 5B is a longitudinal cross-sectional view of the end cap of FIG. 5A taken at A-A of FIG. 5A.

Referring now also to FIGS. 5A and 5B in the drawings, end cap 38 is illustrated. End cap 38 includes sockets 46, threads 66, and bore 68. End cap 38 is connected to valve cage 32 by threads 66 and is preferably secured in place by roll pin 42. Bore 68 runs through the center axis of end cap 38 to allow end cap 38 to be inserted over valve stem 94.

Bore 68 is smooth to allow valve stem 94 to slide inside of bore 68 with limited friction force preventing movement of valve stem 94.

Figure 6A:
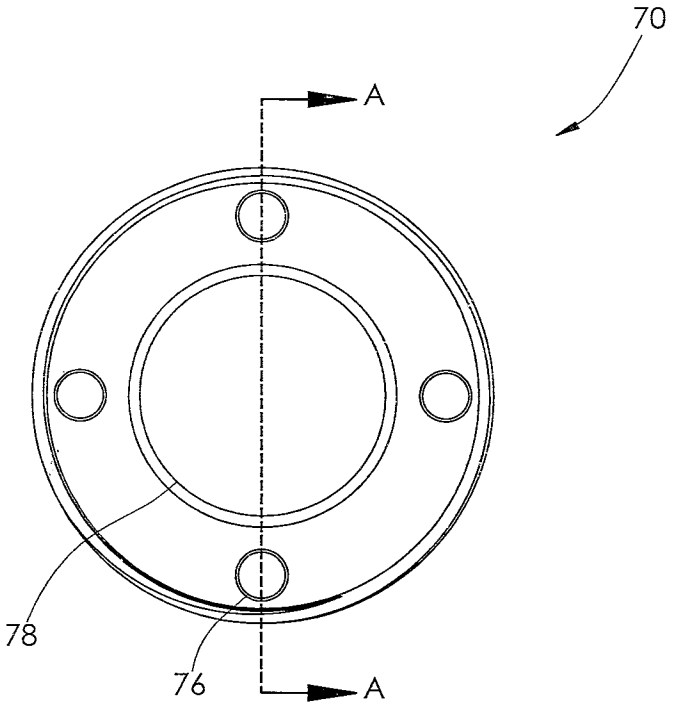
FIG. 6A is an end view of a clutch system of the valve stem assembly of FIG. 3.
Figure 6B:
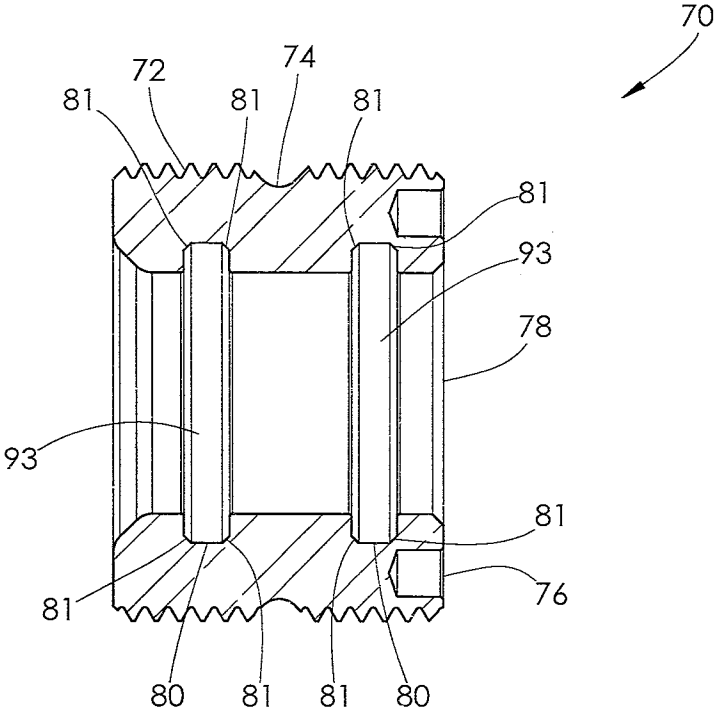
FIG. 6B is a longitudinal cross-sectional view of the clutch system of FIG. 6A taken at A-A of FIG. 6A.

Referring now also to FIGS. 6A and 6B in the drawings, clutch bobbin 70 is illustrated. Clutch bobbin 70 includes external threads 72, roll pin groove 74, sockets 76, bore 78, and one or more internal annular races 80, each race 80 being configured to receive and secure a canted coil spring 92. Clutch bobbin 70 is inserted over valve stem 94 first and is threaded into valve cage 32 via threads 72. Clutch bobbin 70 includes one or more sockets 76 located at selected intervals along the circumference of a front face of clutch bobbin 70, which may be used with a spanner or other tool to advance clutch bobbin 70 into valve cage 32 and tighten clutch bobbin 70 in place. In the preferred embodiment, four sockets 76 are used; however, it will be appreciated fewer or more sockets 76 may be used. Clutch bobbin 70 may include one or more roll pin grooves 74 to receive roll pins 42. By utilizing this configuration for clutch bobbin 70, no window in the side of valve cage 32 is necessary to install clutch bobbin 70.

Annular races 80 extend radially outward from bore 78 and selectively sized and configured to receive and retain canted coil springs 92. Canted coil springs are designed to take side loads. The use of canted coil springs 92 in clutch assembly 64 is unique to plunger lift systems and provides a unique tension force against valve stem 94. Although it is preferred that clutch bobbin 70 include two annular races 80 and two corresponding canted coil springs 92, it will be appreciated that clutch bobbin 70 may have more or fewer annular races 80 and canted coil springs 92. By locating canted coil springs 92 on the interior of clutch bobbin 70, as opposed to the exterior of clutch bobbin 70, canted coil springs 92 can be selectively and particularly sized, shaped, and configured to be the primary source of friction on valve stem 94. Thus, canted coil springs 92 do not have to provide any force to keep a multi-piece clutch bobbin connected. Each annular race 80 preferably includes chamfered ends 81 on each side of each annular race 80. Chamfered ends 81 prevent canted coil springs 92 from spinning while valve stem 94 moves within valve cage 32.

Figure 7A:
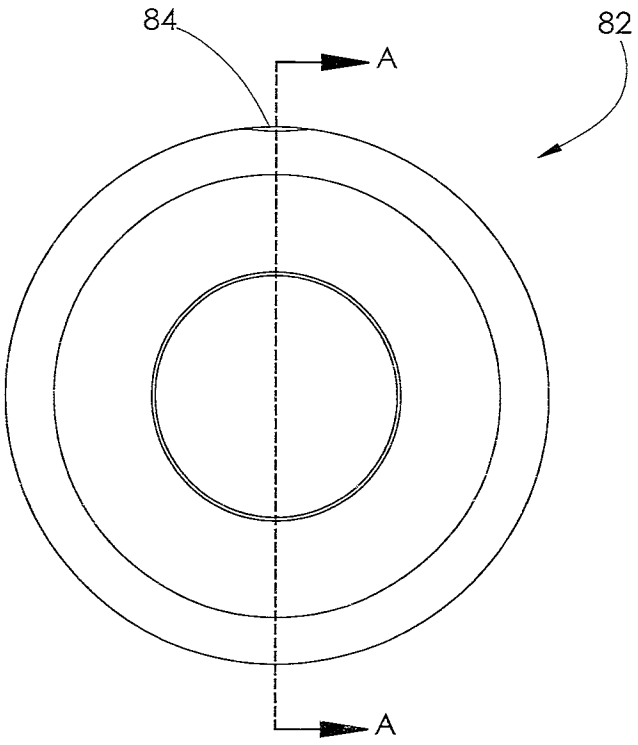
FIG. 7A is a side view of an end cap of a valve stem assembly according to an alternative embodiment of the present application.
Figure 7B:
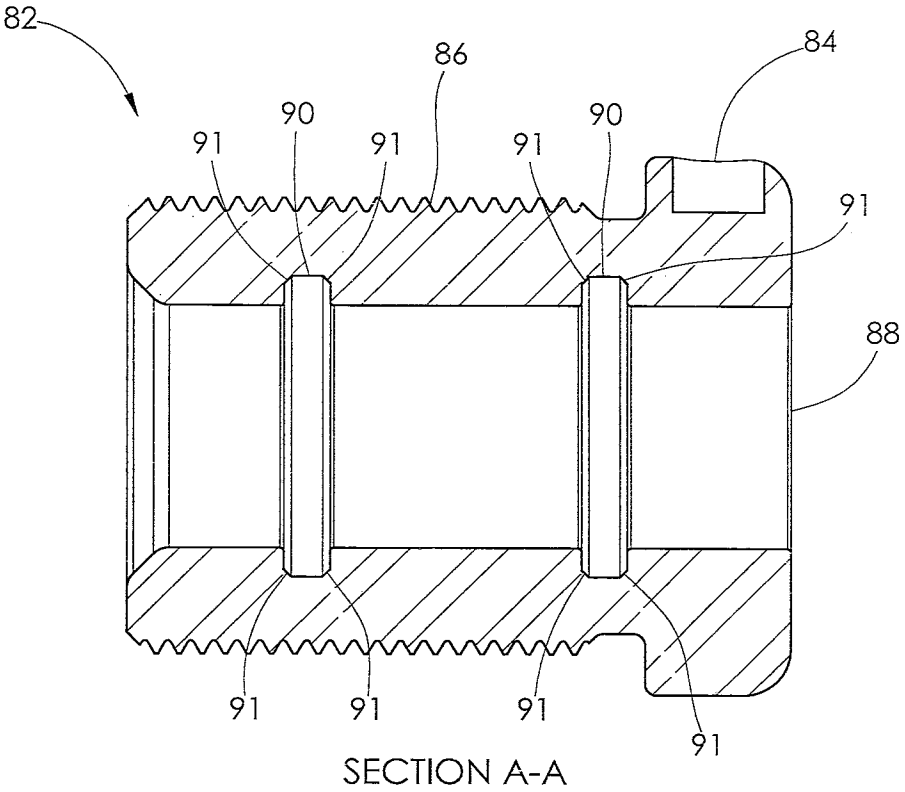
FIG. 7B is a longitudinal cross-sectional view of the end cap of FIG. 7A taken at A-A of FIG. 7A.

Referring now to FIGS. 7A and 7B in the drawings, an alternative embodiment of clutch bobbin 70 and end cap 38 is illustrated. In this embodiment, clutch bobbin 70 and end cap 38 are replaced by a clutch bobbin 82 having an integral end cap. Clutch bobbin 82 includes one or more sockets 84, external threads 86, a bore 88, and one or more interior annular races 90. Annual races 90 are sized and shaped to receive and retain canted coil springs 92. Although two annular races have been shown, it will be appreciated that more or fewer annular races 90 may be utilized. Threads 86 allow clutch bobbin 82 to be installed inside of valve cage 32. Like socket 46 in end cap 38, socket 84 is designed to accommodate a spanner wrench or other tool for easily installing or uninstalling clutch bobbin 82 into valve cage 32. As with clutch bobbin 70, each annular race 90 preferably includes chamfered ends 91 on each side of each annular race 90. Chamfered ends 91 prevent canted coil springs 92 from spinning while valve stem 94 moves within valve cage 32. This one-piece configuration allows the distance between canted coil springs 92 to be increased, which leads to additional stability of plunger 10.

Figure 8:
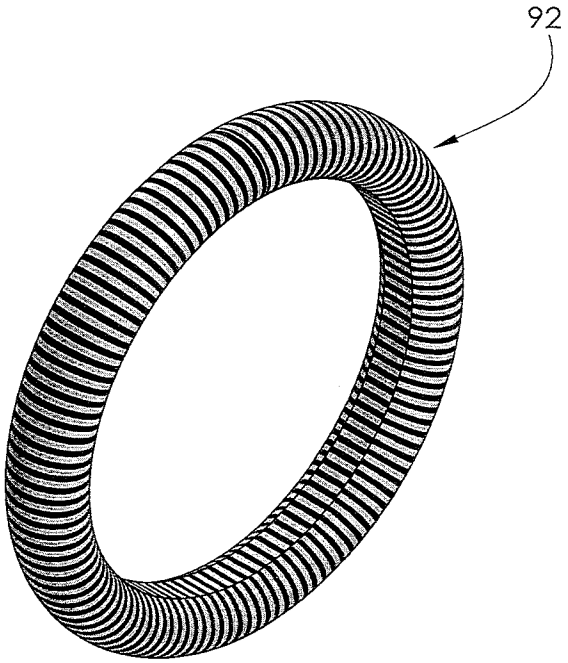
FIG. 8 is a perspective view of a canted coil spring of the valve stem assembly of FIG. 3.

Referring now also to FIG. 8 in the drawings, canted coil spring 92 is illustrated. Although the individual coils are not depicted, canted coil spring 92 is a special coiled spring connected end-to-end in the shape of a circle. Canted coil Spring 92 exerts a near constant radially inward force against valve stem 94. This force is not decreased even if exposed to high temperatures. This inward force on valve stem 94 prevents valve stem 94 from moving axially, until the inward force is exceeded, such as by the inertial force created when the plunger hits the bottom of the well bore. The large number of coils which create canted coil spring 92 compensate for any misalignment or irregularities in canted coil spring 92 from continued use. Because the large number of coils in canted coil spring 92 can compensate for irregularities in the structure of canted coil spring 92, canted coil spring 92 will have an increased durability. This increased durability extends the time that canted coil spring 92 can be used without replacement, thereby extending the life of clutch bobbins 70, 82. Canted coil spring 92 is preferably made from type 174 stainless steel, but may be made with any type of heat resistant material, such as stainless steel, zirconium copper, or beryllium copper. Canted coil spring 92 may be otherwise treated with conventional methods and materials for improved resistance to corrosive materials, further extending the life of canted coil spring 92, clutch bobbin 70, 82, and plunger 10. It is further appreciated that while canted coil springs 92 are used in the present application, alternative embodiments can exist where coiled springs which are not canted are used instead of canted coil springs 92.

Figure 9:
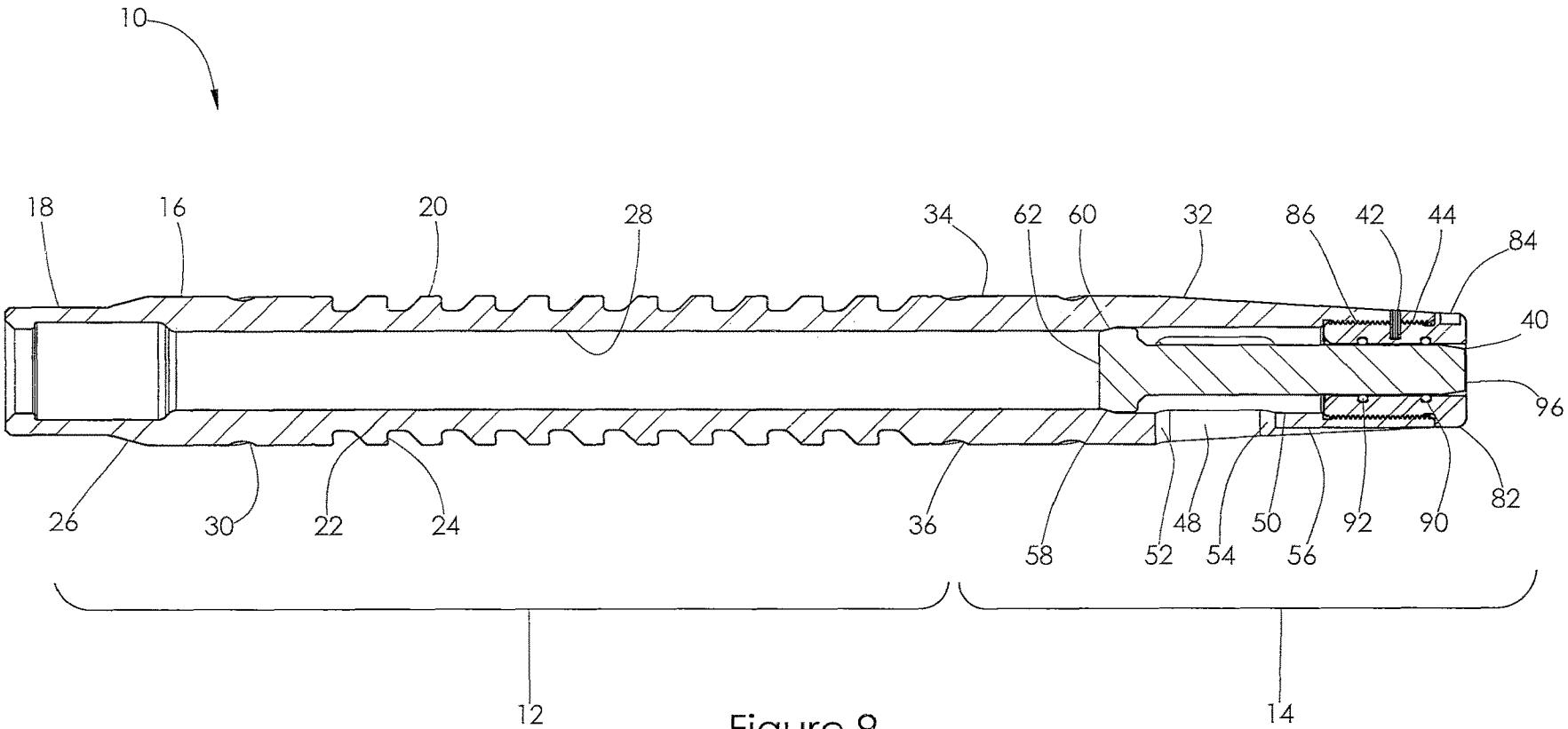
FIG. 9 is a longitudinal cross-sectional view of a plunger lift system according to an alternative embodiment of the present application.

Referring now also to FIG. 9 in the drawings, plunger 10 having clutch bobbin 82 is illustrated. As is shown, clutch bobbin 82 is held in place within valve cage 32 by roll pin 42. Valve stem 94 is shown in the retracted position, i.e., after plunger 10 has encountered the bottom of the well bore.

It is apparent that a system with significant advantages has been described and illustrated. The particular embodiments disclosed above are illustrative only, as the embodiments may be modified and practiced in different but equivalent manners apparent to those skilled in the art having the benefit of the teachings herein. It is therefore evident that the particular embodiments disclosed above may be altered or modified, and all such variations are considered within the scope and spirit of the application. Accordingly, the protection sought herein is as set forth in the description. Although the present embodiments are shown above, they are not limited to just these embodiments, but are amenable to various changes and modifications without departing from the spirit thereof.

What is claimed is:

1. A plunger lift system, comprising:

a plunger body having a central bore; and a bypass valve assembly disposed at a lower end of the plunger body, the bypass valve assembly comprising:

a valve cage;

a valve stem disposed at least partially within the valve cage;

a unibody clutch bobbin carried by the valve cage and being operably associated with the valve stem, wherein the clutch bobbin comprises external threads for engagement with the valve cage and at least one socket disposed on a lower face of the clutch bobbin for installing and uninstalling the clutch bobbin into the valve cage;

at least one canted coil spring disposed at least partially within the clutch bobbin for controlling movement of the valve stem;

an end cap coupled to the valve cage and extending partially into the valve cage, the end cap securing the clutch bobbin within the valve cage.

2. The plunger lift system of claim 1, wherein the bypass valve assembly further comprises:

an internal annular race for receiving each canted coil spring.

3. The plunger lift system of claim 2, wherein the bypass valve assembly further comprises:

chamfered ends on each side of each internal annular race to prevent the canted coil spring from spinning as the valve stem moves within the valve cage.

4. The plunger lift system of claim 1, wherein the clutch bobbin comprises a cylindrical bore running axially through the center of the clutch bobbin.

5. The plunger lift system of claim 4, wherein the clutch bobbin further comprises:

at least one socket disposed on a lower face of the clutch bobbin for installing and uninstalling the clutch bobbin into the valve cage.

6. The plunger lift system of claim 1, wherein the valve stem comprises:

an enlarged stem head;

a chamfered perimeter around the stem head; and a straight shaft portion having a smooth surface, the shaft portion extending down from the stem head.

7. The plunger lift system of claim 6, wherein the plunger body comprises:

an internal seat formed in a bore disposed within the valve cage, the internal seat being configured to receive the enlarged stem head so as to form a seal between the valve stem and the central bore.

8. The plunger lift system of claim 1, wherein the valve stem is operable between an extended open position in which fluid may flow through the valve cage into the central bore, and a retracted closed position, in which the flow of fluid through the valve cage into the central bore is prevented.

9. The plunger lift system of claim 1, wherein the plunger body comprises:

a series of concentric outer rings, each outer ring having at least one sloped surface; and a tapered portion disposed near the upper end of the plunger body.

10. The plunger lift system of claim 1, wherein the plunger body comprises:

at least one helical groove located on an exterior surface of the plunger body.

11. The plunger lift system of claim 1, wherein the plunger body further comprises:

a bore running through the plunger body.

12. The plunger lift system of claim 1, wherein the bypass valve assembly further comprises:

one or more ports located along the valve cage to allow fluids to flow into the valve cage.

13. The plunger lift system of claim 12, wherein the bypass valve assembly further comprises:

a ramp associated with each port to facilitate fluid flow into the valve cage.

* * * * *